United States Patent [19]

Regan et al.

[11] Patent Number: 4,674,920

[45] Date of Patent: Jun. 23, 1987

[54] SUBSEA WELL TEMPLATE LEVELLING SYSTEM

[75] Inventors: A. Michael Regan, Huntington Beach; Eugene S. Matsuda, Laguna Hills, both of Calif.

[73] Assignee: Hughes Tool Company, Houston, Tex.

[21] Appl. No.: 778,598

[22] Filed: Sep. 20, 1985

[51] Int. Cl.[4] ..... E02B 17/08

[52] U.S. Cl. ..... 405/227; 405/228

[58] Field of Search ..... 405/195, 224, 196, 199, 405/227, 228

[56] References Cited

U.S. PATENT DOCUMENTS

| | | | |
|---|---|---|---|
| 3,489,212 | 1/1970 | Rininger et al. | 166/0.5 |
| 3,672,177 | 6/1972 | Manning | 61/46.5 |
| 4,367,056 | 1/1983 | Seneviratne | 405/224 X |
| 4,408,932 | 10/1983 | Cowan | 405/227 |

OTHER PUBLICATIONS

Vetco-I. B. Continued 3. *Template Leveling Method*

*Primary Examiner*—David H. Corbin

*Attorney, Agent, or Firm*—James E. Bradley

[57] ABSTRACT

A template levelling system includes a pile receptacle carried within the template receptacle mounted to the template. The pile receptacle has a lower flange that extends outwardly from and below the template receptacle. Slips are located in the pile receptacle for gripping the pile to prevent downward movement of the template. A hydraulic jack will grip the pile receptacle and pull the pile receptacle upwardly, causing the flange to contact the lower side of the template to lift the template. The pile receptacle is laterally movable in the template receptacle. A release sleeve can selectively release the slips to allow the pile receptacle to be lowered on the pile.

5 Claims, 7 Drawing Figures

63
69
65
71
51
13

13
51
81
83
19
15
78
27
23
39
35
37

78
77
79
76
19
74
75
15
23
21
73
29
27
35
39
37

SUBSEA WELL TEMPLATE LEVELLING SYSTEM

BACKGROUND OF THE INVENTION

1. Field of the Invention:

This invention relates to subsea well templates, and in particular to devices for levelling the template on pilings.

1. Description of the Prior Art:

A subsea template is a structure having a number of guide bushings through which drilling equipment is lowered to drill wells. The wells are completed through the template, and the template remains in place on the subsea floor after completion of the wells. The template is supported on the subsea floor by pilings which are cemented into the surface of the earth.

The ocean floor is often not level. Consequently, the template must be leveled on the pilings, which are cemented vertically in the subsea floor. There are various methods for levelling the templates. Normally, the template will be lowered onto the floor, resting in whatever position that the floor inclines at that point. Holes are then drilled in the earth through the receptacles for the piles. The piles are cemented in place. Then, a hydraulic jacking assembly raises the template to a level position on the pile. A locking device supports the template on the piles at the level position.

SUMMARY OF THE INVENTION

The template levelling system of this invention includes a pile receptacle carried in each template receptacle on a gimbal. The pile receptacle has a lower flange extending outwardly from and below the template receptacle. A slip ring is located in the pile receptacle for gripping one of the piles. A hydraulic jack is adapted to engage the pile receptacle and pull it upwardly. The lower flange contacts the lower surface of the template receptacle, lifting the template to a level position.

As the template levels, there may be a change in horizontal distance between the pile receptacles. To prevent binding and accommodate this change in length, the pile receptacle is carried on a bushing located in the template receptacle which can move laterally with respect to the template receptacle.

DESCRIPTION OF THE PREFERRED EMBODIMENT

Figure 1:
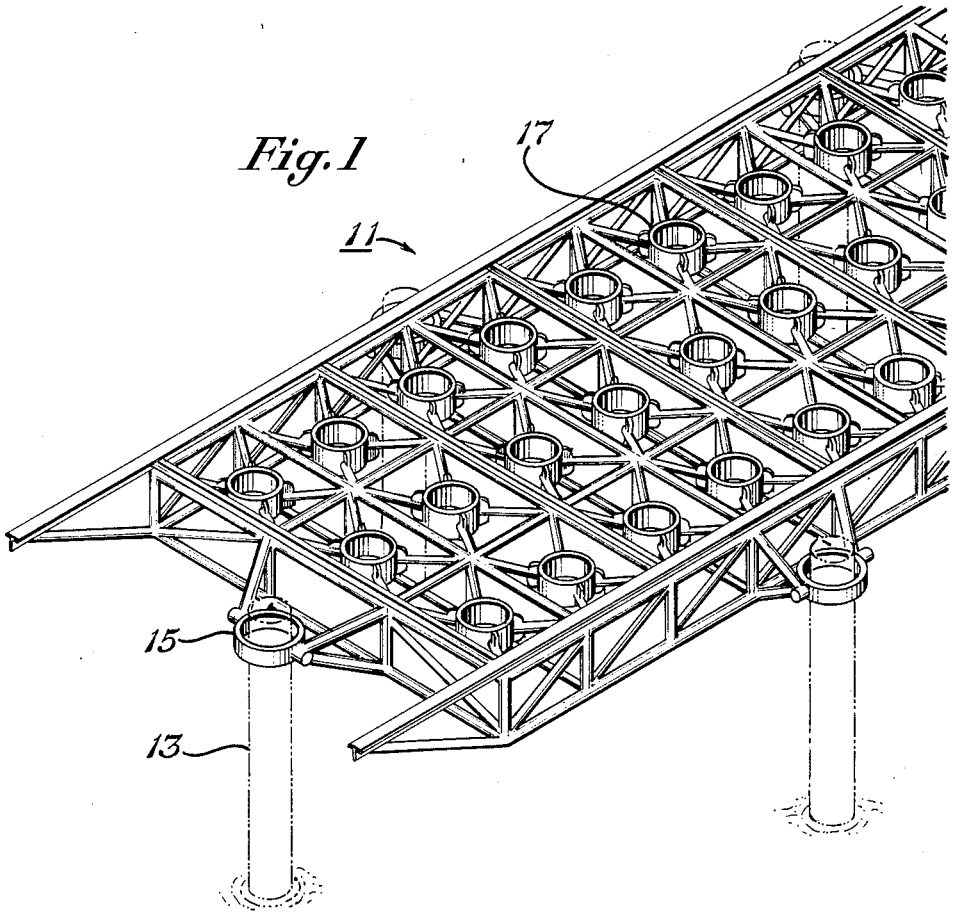
FIG. 1 is a partial perspective view of a subsea template.

Referring to FIG. 1, template 11 is shown supported on piles 13. The template 11 has pile receptacle assemblies 15 located at the ends and sides which support the template 11 on the piles 13. Template 11 has a number of guide bushings 17 through which wells will be drilled.

Figure 2:
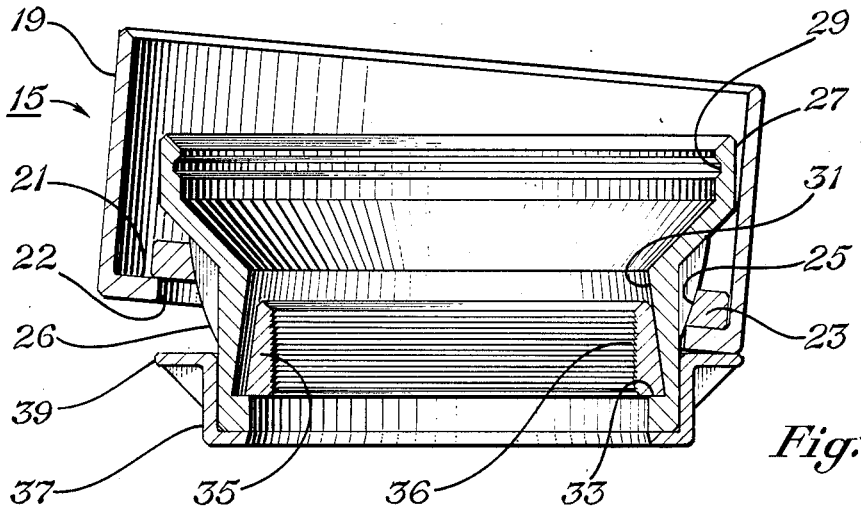
FIG. 2 is an enlarged sectional view of one of the pile receptacle assemblies for the template of FIG. 1.

Referring to FIG. 2, each pile receptacle assembly 15 includes a template receptacle 19. The template receptacle 19 is welded to the template 11. The template receptacle 19 is shown in a tilted position in FIG. 2, to emphasize how the template might be located on the subsea floor prior to levelling. Template receptacle 19 is a metal cylinder having a lower lip 21 which extends inwardly a short distance defining a hole 22.

A bushing 23 is carried on the lip 21. Bushing 23 is an annular metal ring having a gimballed inner surface 25. The inner surface 25 is preferably a portion of a sphere. The outer diameter of the bushing 23 is significantly less than the inner diameter of the template receptacle 19 and hole 22. This allows the bushing 23 to slide laterally on lip 21 with respect to the template receptacle 19. The axis of the bushing 23 will always be parallel with the axis of the template receptacle 19, but it will not necessarily coincide with the axis of the template receptacle 19, as shown in FIG. 2.

A pile receptacle 27 is slidably carried by the bushing 23. The pile receptacle 27 has spherical ribs 26, each having a spherical outer surface that mates with the inner surface 25 of the bushing 23. This allows the gimbal movement to occur, with the pile receptacle 27 normally sliding to a vertical position, as shown in FIG. 2, due to its weight. Pile receptacle 27 is able to tilt with respect to the template receptacle 19 in this manner.

The pile receptacle 27 has an upper enlarged portion containing an interior annular groove 29. The enlarged portion tapers downwardly to a lesser diameter portion having a conical interior 31. The conical interior 31 tapers from a reduced diameter at the upper end to an enlarged diameter at the lower end. A lip 33 is located at the base or bottom of the conical interior portion 31.

A split ring 35 is carried in the conical interior portion 31. Split ring 35 has a cylindrical interior with parallel concentric grooves 36 and a conical exterior. The conical exterior mates with the conical interior portion 31. Split ring 35, when in the lower position resting on lip 33, has a diameter that is less than the diameter of the conical interior portion at that point. This provides a clearance, allowing it to expand when a pile 13 is lowered through the split ring 35. A wedging action occurs when the split ring 35 is moved upwardly relative to the conical interior portion 31. When the split ring 35 is at an upper position in the conical interior portion 31, its interior diameter will be reduced due to the wedging of the conical interior portion 31.

A flange 37 is rigidly mounted to the bottom of the pile receptacle 27 by bolts or otherwise. Flange 37 has on its upper end an outwardly extending lip 39. Lip 39 has a diameter larger than the hole 22, preventing the pile receptacle 27 from being removed from the template receptacle 19. The lip 39 of flange 37 is adapted to contact the lower side of the lip 21 of the template receptacle 19 when the pile receptacle 27 is pulled upwardly.

Figure 3:
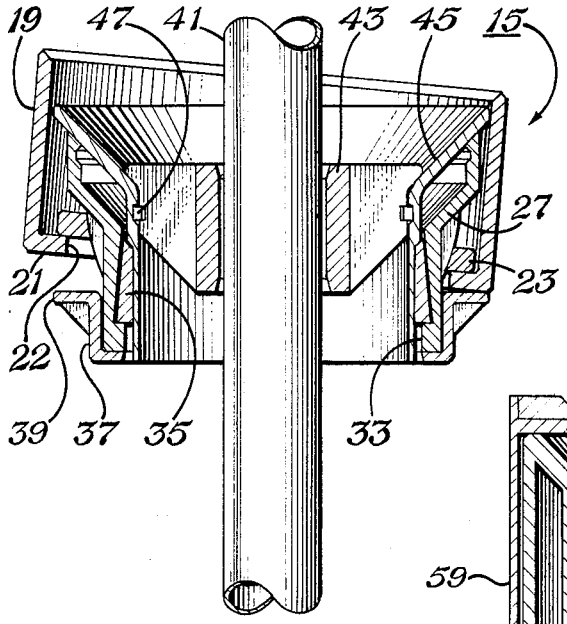
FIG. 3 is a view of the pile receptacle assembly of FIG. 2, and showing a drill string extending therethrough for drilling a hole for a pile.

Referring to FIG. 3, after the template 11 has been lowered onto the subsea floor, drill pipe 41 is lowered through for drilling a hole for the pile 13. The drill bit (not shown) will be located on the bottom of the drill pipe. The drill pipe is centralized within the pile receptacle 27 by a centralizer 43. Centralizer 43 lands in a protective sleeve 45, which is run with the pile receptacle 27. A lock ring 47 locks the centralizer 43 to the protective sleeve 45, and is used to pull the sleeve 45. The protective sleeve 45 has a conical upper portion that rests on the upper portion of the pile receptacle 27. A lower portion of protective sleeve 45 extends into slip ring 35 to protect the grooves 36.

Figure 4:
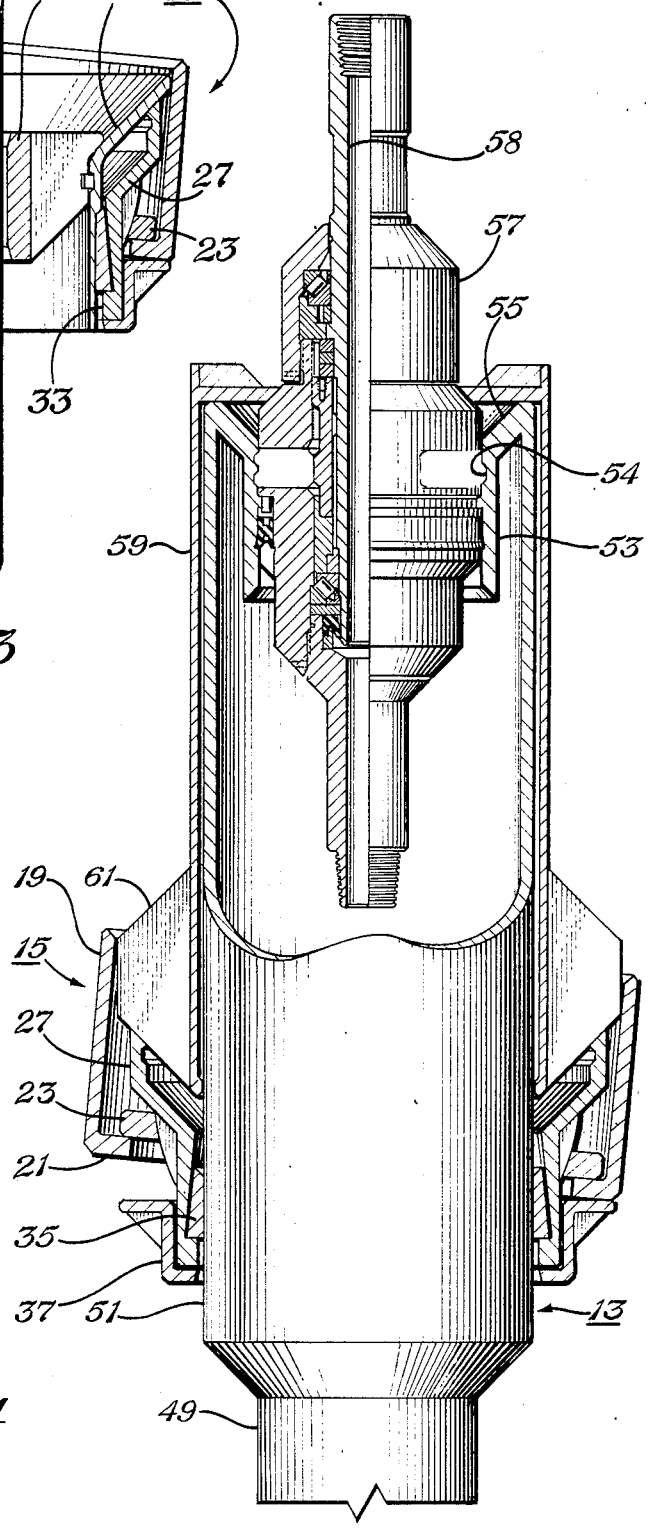
FIG. 4 is a sectional view of the pile receptacle assembly of FIG. 2, and showing a pile running tool lowering the pile through the receptacle.

After the hole is drilled for the pile 13, the bit is pulled along with centralizer 43 and protective sleeve 45. Then the pile 13 is lowered into the hole and cemented in place, as indicated in FIG. 4. Pile 13 has a lower portion 49 that is of lesser diameter than the upper portion 51. The upper portion 51 has a receptacle 53 located in the interior portion. The receptacle 53 is cylindrical, having concentric grooves 54 in the interior. A beveled surface 55 joins the receptacle 53 to the outer walls of the pile upper portion 51.

A pile running tool 57 is adapted to fit within the receptacle 53 to lower the pile 13 in place. The pile running tool 57 has mechanical actuating means for engaging the grooves 54. Also, the pile running tool 57 has a passage 58 extending through it for pumping cement for cementing the pile in place. The pile running tool 57 includes an outer sleeve 59 that contacts the upper end of the pile 13 and extends downwardly over part of the upper portion 51. Sleeve 59 has centralizers 61 for engaging the template receptacle 19 to centralize the pile 13 in the template receptacle 19.

Figure 5:
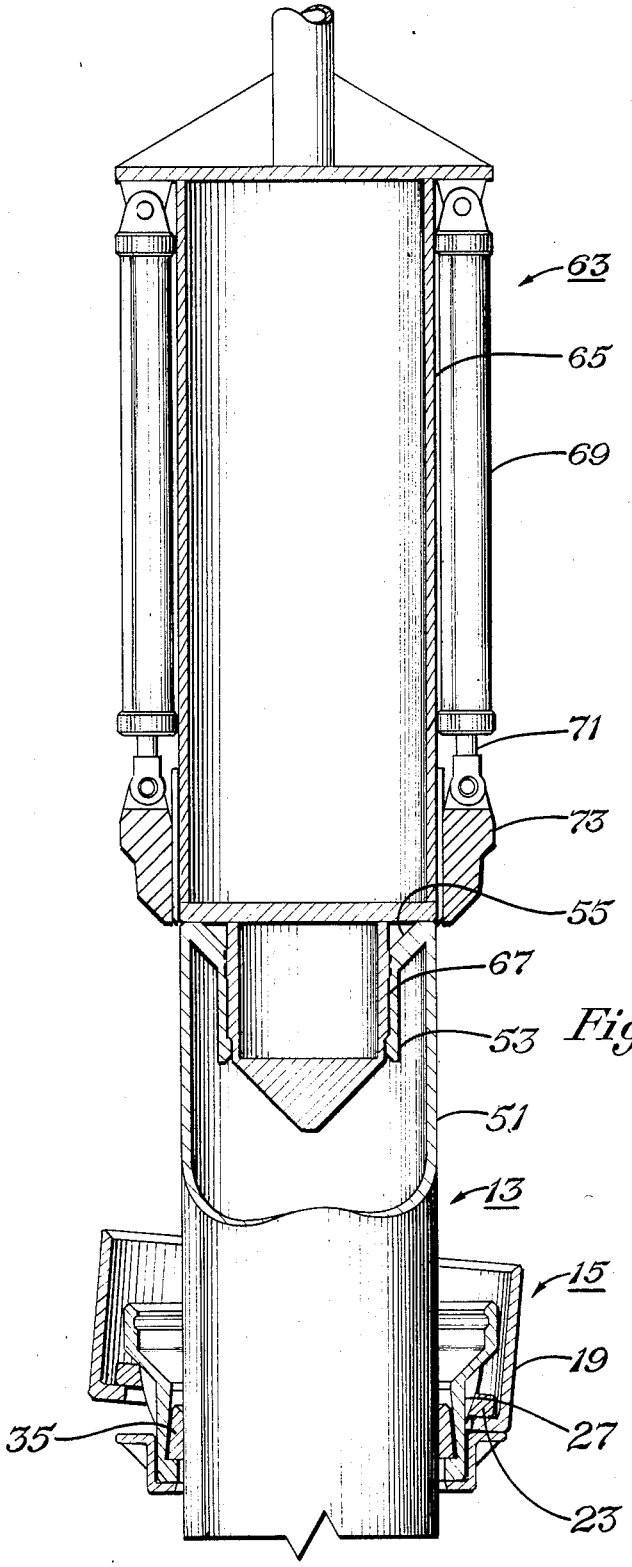
FIG. 5 is a view of the template receptacle assembly of FIG. 1, showing a hydraulic jack assembly lowered into place on the pile.

After cementing, a template levelling tool 63 is lowered onto the pile 13, as shown in FIG. 5. The template levelling tool 63 has an upper cylindrical portion 65 and a stinger 67 on its bottom. The stinger 67 engages the receptacle 53. The upper cylindrical portion 65 rests on the top of the pile 13. The template levelling tool 63 has hydraulic cylinders 69 extending downwardly. Each hydraulic cylinder has a rod 71 that moves between the retracted position shown in FIG. 5 and the extended position shown in FIG. 6. An annular gripping member 73 mounted to the lower ends of the rods 71 and encircles pile 13.

Figures 6, 7:
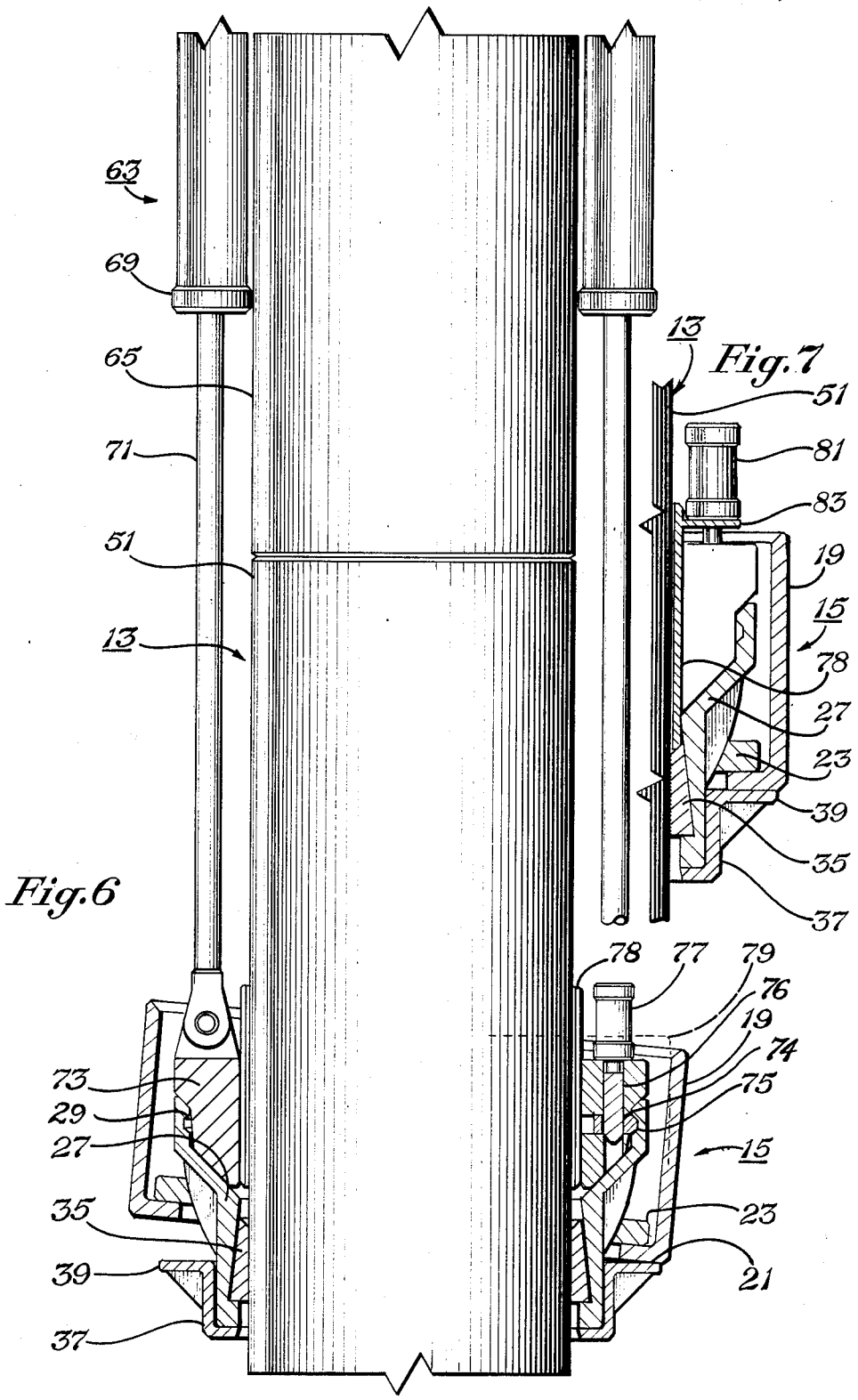
FIG. 6 is a view of the template receptacle assembly of FIG. 2, showing the hydraulic jack assembly engaging the pile receptacle to level the template.
FIG. 7 is a partial sectional view of the hydraulic jack assembly shown in FIG. 6, taken from a different sectional plane than FIG. 6.

As shown in FIG. 6, the gripping member 73 carries a plurality of dogs 75 for engaging the groove 29 in the pile receptable 27. Dogs 75 move between a radially inward position (not shown) to a radially outward position to engage the groove 29. Each dog is moved outwardly by a rod 76 of a hydraulic cylinder 77 carried by the gripping member 73. Rod 76 passes through a vertical hole 74 located in the dog 75 to wedge it outwardly. Once engaged, the hydraulic cylinders 69 can be actuated to move the rods 71 upwardly, pulling the pile receptable 27 with it. The lip 39 of flange 37 will contact the template receptacle 19 to move the template upwardly, as shown by the dotted lines 79.

A release sleeve 78 is reciprocally carried by the gripping member 73, as shown in FIGS. 6 and 7. A piston 81 (FIG. 7) moves the sleeve 78 up and down by contacting a bracket 83 mounted to sleeve 78. Piston 81 does not appear in the sectional view of FIG. 6. Piston 81 is mounted to the release sleeve 78 and is located between two of the hydraulic cylinders 77 used for moving the dogs 75. Sleeve 78 is shown in the upper position in FIG. 6 and in a lower position in FIG. 7 pushing split ring 35 downwardly.

In operation, the template 11 will be lowered onto the subsea floor and allowed to come to rest in whatever inclination that normally exists at that point. Next, as shown in FIG. 3, drill pipe 41 is lowered through the pile receptacle 27 to drill the hole, which will be in a true vertical orientation. The template may be leaning, as indicated by the inclination of the template receptacle 19 in FIG. 3. Then, the pile 13 is lowered into the hole and cemented, as shown in FIG. 4. It is lowered into the hole using the pile running tool 57.

After cementing, the template levelling tool 63 is lowered in place, as shown in FIG. 5. The rods 71 are lowered as shown in FIG. 6, and the hydraulic cylinders 77 actuated to move the dogs 75 into engagement with the pile receptacle 27. The hydraulic cylinders 69 will then actuate to retract the rods 71. This draws the pile receptacle 27 upwardly relative to the pile 13. The flange lip 39 contacts the template receptacle 19 and pushes the template receptacle 19 and the template 11 upwardly to a level position, as shown by the dotted lines 79. Television monitors can be used to determine when the desired point is reached.

Once the approximate level is reached, the rods 71 may be moved downwardly to move the pile receptacle 27 downwardly with respect to the pile 13. The grooves 36 on the interior of the split ring 35 grip the pile 13, causing it to remain stationary. The downward movement of the pile receptacle 27 with respect to the split ring 35, causes the split ring 35 to further contract and tightly grip the pile 13.

Because of the smaller diameter of bushing 23 than the inner diameter of template receptacle 19, some lateral movement of pile receptacles 27 relative to tamplate receptacle 19 can occur as the template 11 is levelled.

If, after further levelling, it appears that the pile receptacle 27 should be moved lower on the pile 13, this is handled by moving the release sleeve 78 downwardly. The piston 81, shown in FIG. 7, moves the release sleeve 78 downwardly, contacting the upper end of the split ring 35, and pushing it downwardly with respect to the pile receptacle 27. This causes the split ring 35 to expand its diameter, and release its grip on the pile 13. Then, the hydraulic cylinders 69 can be actuated to move the pile receptacle 27 downwardly to the desired point. At the desired point, the hydraulic cylinder 81 can be retracted, moving the release sleeve 78 upwardly. This allows the split ring 35 to again grip the pile 13 as the pile receptacle 27 is moved downwardly with respect to the split ring 35.

When properly leveled, the cylinders 77 are actuated to move the rod 76 upwardly to free the dogs 75 for lateral movement. The hydraulic cylinders 69 are actuated to retract the rods 71. As gripping member 73 is pulled upwardly, the dogs 75 move inward slightly. The template levelling tool 63 is pulled to the surface.

The invention has significant advantages. The structure is simple and effective. The locking system allows lateral movement of the pile receptacle relative to the template receptacle to accommodate changes in the horizontal distance between the pile receptacles as the system is levelled. The template can be lowered on a piling by pushing on the split ring. All of the hydraulic components are retrieved to the surface once levelled.

While the invention has been shown in only one of its forms, it should be apparent to those skilled in the art that it is not so limited but is susceptible to various changes without departing from the scope of the invention.

We claim:

1. A template levelling system for levelling a template on a plurality of piles implanted in the floor of a body of water, the template having a plurality of template receptacles, comprising in combination:

a pile receptacle carried in each template receptacle on a gimbal, the pile receptacle having a lower flange extending outwardly from and below the template receptacle;

slip means located within each of the pile receptacles for gripping one of the piles to prevent downward movement of the template with respect to the piles; and hydraulic jack means for gripping the pile receptacle and pulling it and the slip means upwardly, causing the flange to contact the lower side of the template receptacle to lift the template to a level position.

2. A template levelling system for levelling a template on a plurality of piles implanted in the floor of a body of water, comprising in combination:

a plurality of cylindrical template receptacles mounted to the template;

an annular bushing having a gimballed inner surface, carried in the template receptacle, the bushing having a smaller outer diameter than the inner diameter of the template receptacle, allowing lateral movement relative thereto;

a pile receptacle having a gimballed outer surface positioned for support on the bushing for gimballed movement thereto, and for lateral movement with respect to the template receptacle;

flange means on the pile receptacle for moving upwardly into contact with the template receptacle to lift the template receptacle for levelling as the pile receptacle is lifted;

slip means located within each of the pile receptacles for gripping one of the piles to prevent downward movement of the template with respect to the pile; and hydraulic jack means for gripping the pile receptacle and pullng it and the slip means upwardly, causing the flange means to contact the template receptacle to lift the template to a level position.

3. A template levelling syustem for levelling a template on a plurality of piles implanted in the floor of a body of water, the template having a plurality of template receptacles, comprising in combination:

a pile receptacle gimballed in each template receptacle, the pile receptacle having a lower flange extending outwardly from and below the template receptacle;

the pile receptacle having an enlarged diameter upper portion carried within the template receptacle and having an internal groove therein;

the pile receptacle having a cylindrical lower portion having an interior conical portion that diverges in a downward direction;

a split ring carried in the conical portion, having grooves in its interior for gripping a pile; and hydraulic jack means, for contacing the top of each pile, and having a gripping member for engaging the internal groove in the pile receptacle and lifting the pile receptacle, causing the flange to contact the template receptacle to lift the template to a desired level, then for allowing the pile receptacle to move downwardly with respect to the pile, causing the split ring to move upwardly in the conical interior to grip the pile and support the template on the pile.

4. A template levelling system for levelling a template on a plurality of piles implanted in the floor of a body of water, the template having a plurality of template receptacles, comprising in combination:

an annular bushing having a gimballed inner surface, carried in the template receptacle, the bushing having a smaller outer diameter than the inner diameter of the template receptacle, allowing lateral movement relative thereto;

a pile receptacle having a gimballed outer surface positioned for support on the bushing for gimballed movement thereto, and for lateral movement with respect to the template receptacle;

slip means located within each pile receptacle for wedging into gripping contact with one of the piles as the pile receptacle is moved downwardly relative to the slip means;

hydraulic jack means for gripping the pile receptacle and moving it upwardly and downwardly relative to the pile to level the template, the downward movement of the pile receptacle relative to the pile causing the slip means to wedge into gripping contact with the pile to support the template on the pile; and release means mounted to the hydraulic jack means, for selectively moving the slip means downwardly relative to the pile receptacle to release wedging contact of the slip means with the pile receptacle, allowing the pile receptacle to be lowered on the pile.

5. A template levelling system for levelling a template on a plurality of piles implanted in the floor of a body of water, the template having a plurality of template receptacles, comprising in combination:

a pile receptacle gimballed in each template receptacle, the pile receptacle having an enlarged diameter upper portion with an internal groove therein, the pile receptacle having a lower portion with a conical interior portion that diverges in a downward direction;

an annular split ring carried within the conical interior portion, for movement between an upper pile gripping position and a lower release position;

an annular gripping member adapted to be inserted into the pile receptacle, having a plurality of dogs movable between an inward retracted position and an outward engaged position engaging the internal groove;

gripping piston means carried by the gripping member for moving the dogs to the engaged position;

hydraulic jack means for moving the annular gripping member into the pile receptacle and for moving the gripping member upwardly and downwardly relative to the pile after the gripping member has engaged the pile receptacle to level the template, the downward movement of the pile receptacle relative to the pile causing the pile receptale to move downwardly relative to the split ring, positioning the split ring in the upper pile gripping position; and a release member carried by the annular gripping member and movable between an upper position and a lower position pushing the split ring into the lower release position, allowing the pile receptacle to be lowered relative to the pile to a new position; and release member piston means carried by the gripping member for moving the release member between the upper and lower positions.

* * * * *